US009393707B2

(12) United States Patent
Wevers et al.

(10) Patent No.: US 9,393,707 B2
(45) Date of Patent: Jul. 19, 2016

(54) HAIR CUTTING DEVICE WITH COMB UNIT RECOGNITION

(75) Inventors: Dirk Hendrik Wevers, Drachten (NL); Hendrik Jan Mark Van Der Worp, Zwolle (NL); Auke Tuinstra, Drachten (NL); Johan Willem Berenschot, Westerbork (NL); Hedzer Michiel Adriaan Van Der Kamp, Zutphen (NL); Willem Joosten, Veendam (NL); Marcel Hilco Zijlstra, Leeuwarden (NL); Ishay Halmut, Groningen (NL); Jeroen Christian Nijdam, Noordhorn (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 398 days.

(21) Appl. No.: 13/503,762

(22) PCT Filed: Nov. 10, 2010

(86) PCT No.: PCT/IB2010/055102

§ 371 (c)(1),
(2), (4) Date: Apr. 24, 2012

(87) PCT Pub. No.: WO2011/061660

PCT Pub. Date: May 26, 2011

(65) Prior Publication Data

US 2012/0216411 A1 Aug. 30, 2012

(30) Foreign Application Priority Data

Nov. 17, 2009 (EP) ..... 09176159

(51) Int. Cl.
*B26B 19/20* (2006.01)
*B26B 19/38* (2006.01)

(52) U.S. Cl.
CPC ..... *B26B 19/20* (2013.01); *B26B 19/388* (2013.01); *B26B 19/3813* (2013.01); *B26B 19/3853* (2013.01)

(58) Field of Classification Search
CPC .... B26B 19/20; B26B 19/205; B26B 19/388; B26B 19/3853; B26B 19/3813
USPC ..... 30/201, 200, 233.5, 41.7, 131, 233; 83/522.15, 522.16, 522.19, 522.17, 83/522.21; 116/202, 282, 238, 281
See application file for complete search history.

(56) References Cited

U.S. PATENT DOCUMENTS 3,287,805 A 11/1966 Du Charme
4,669,189 A * 6/1987 Ullmann ..... 30/201

(Continued)

FOREIGN PATENT DOCUMENTS

DE 3800966 A1 7/1989
EP 119285 A1 * 9/1984

(Continued)

OTHER PUBLICATIONS

English Translation of FR2903929.*

*Primary Examiner* — Kenneth E. Peterson
*Assistant Examiner* — Jennifer Swinney

(57) ABSTRACT

A hair cutting device includes a hair cutting device body and an interchangeable comb unit for defining a hair length after cutting. The hair cutting device body further includes a comb interface for releasable attachment of the comb unit to the hair cutting device body, and a hair length indicator operatively coupled to the comb interface for indicating the hair length to a user. The interchangeable comb unit includes a comb identification member for identifying a hair length associated with the comb unit, and the comb interface includes a comb recognition arrangement being electrically coupled to the hair length indicator. The comb recognition arrangement is configured to sense the comb identification member when the comb unit is connected to the hair cutting device body, and to provide an electronic signal indicative of the hair length associated with the comb unit to the hair length indicator.

2 Claims, 4 Drawing Sheets

(56) References Cited

U.S. PATENT DOCUMENTS

| | | | | | |
|---|---|---|---|---|---|
| 4,776,095 | A | * | 10/1988 | Tsujimoto et al. | 30/201 |
| 4,969,266 | A | * | 11/1990 | Poganitsch | 30/34.05 |
| 5,259,115 | A | | 11/1993 | Bluder et al. | |
| 5,898,999 | A | * | 5/1999 | Chaouachi et al. | 30/201 |
| 6,578,269 | B2 | * | 6/2003 | Wilcox et al. | 30/201 |
| 6,725,754 | B2 | * | 4/2004 | MacKenzie | 83/467.1 |
| 6,968,623 | B2 | * | 11/2005 | Braun et al. | 30/201 |
| 2003/0056374 | A1 | | 3/2003 | Langley | |
| 2005/0000044 | A1 | * | 1/2005 | Hilscher | A46B 5/0095 15/22.1 |
| 2007/0227011 | A1 | | 10/2007 | Caric | |
| 2010/0064520 | A1 | * | 3/2010 | Park | B26B 19/06 30/29.5 |

FOREIGN PATENT DOCUMENTS

| | | | | |
|---|---|---|---|---|
| EP | 1880811 | A1 | | 7/2007 |
| FR | 2903929 | | * | 7/2009 |
| WO | 2006134576 | A2 | | 12/2006 |

* cited by examiner

HAIR CUTTING DEVICE WITH COMB UNIT RECOGNITION

CROSS REFERENCE TO PRIOR APPLICATIONS

This Application is the U.S. National Phase application under 35 U.S.C. §371 of International Patent Application PCT/IB2010/055102, filed Nov. 10, 2010, which claims benefit of European Patent Application No. 09176159.3 filed Nov. 17, 2009.

FIELD OF THE INVENTION

The present invention relates to a hair cutting device comprising a hair cutting body and an interchangeable comb unit for defining a hair length after cutting.

BACKGROUND OF THE INVENTION

Currently available hair cutting devices, typically have a hair cutting body with an electric motor powering cutting knives for cutting the hair of a person or a pet. The hair length after cutting is generally determined through proper selection of interchangeable comb unit defining the distance between the skin and the cutting knives.

For user convenience, some hair cutting devices allow for the comb unit to be moved so that the hair length can be changed within a hair length range that is supported by the particular comb unit.

In addition to allowing for such movement of the comb unit relative to the cutting knives, the hair cutting device disclosed by WO 2006/134576 provides a graphical indication of the hair length to the user by means of a hair length indicator comprising a fixed delimiter and movable delimiters that move together with the comb unit when the comb unit is moved.

In the hair cutting device according to WO 2006/134576, the comb unit that is attached to the hair cutting device interacts with a lever that is mechanically coupled with the movable delimiters to move these in a circumferential direction when the lever is actuated. Only one of the movable delimiters at a time is visible to the user through a transparent window. By selectively activating levers on opposite sides (left and right) of the comb unit, two different movable delimiters can be displayed to the user depending on which comb unit is used, so that the hair length that is indicated to the user is adapted to the comb unit that is currently mounted on the hair cutting device.

Although the hair cutting device according to WO 2006/134576 gives the user proper information about the currently set hair length, there still appears to be room for improvements, for example in respect of the reliability of the hair cutting device.

SUMMARY OF THE INVENTION

In view of the above-mentioned prior art, a general object of the present invention is to provide an improved hair cutting device, in particular a hair cutting device that is more reliable.

To achieve this object, the present invention provides a hair cutting device comprising a hair cutting device body; and an interchangeable comb unit for defining a hair length after cutting, the hair cutting device body further comprising a comb interface for releasable attachment of the comb unit to the hair cutting device body; a hair length indicator operatively coupled to the comb interface for indicating the hair length to a user, wherein: the interchangeable comb unit comprises a comb identification member identifying a hair length associated with the comb unit; and the comb interface comprises a comb recognition arrangement being electrically coupled to the hair length indicator, the comb recognition arrangement being configured to sense the comb identification member when the comb unit is connected to the hair cutting device body, and to provide an electronic signal indicative of the hair length associated with the comb unit to the hair length indicator.

The hair length after cutting is generally determined by the distance between cutting means, such as one or several knives, comprised in the hair cutting device body and the comb unit. Accordingly, the comb unit defines the hair length after cutting.

The comb recognition arrangement may be directly electrically coupled to one or several electronic components comprised in the hair length indicator, or may be indirectly electrically coupled to the hair length indicator via one or several other electronic components comprised in the hair cutting device, such as processing circuitry configured to control the hair length indicator.

The electronic signal provided by the comb recognition arrangement to the hair length indicator may be provided directly to one or several electronic components comprised in the hair length indicator or to processing circuitry being configured to control the hair length indicator. Such processing circuitry may be arranged together with the hair length indicator or may be arranged elsewhere in the hair cutting device and be electrically connected to the hair length indicator.

The hair length indicator may indicate the hair length after cutting to the user in various ways. For example, the hair length may be indicated by numbers and/or using a relative scale on a display, or the hair length may be indicated by giving an indication in live scale of the hair length after cutting. Such an indication in live scale may be provided electronically or mechanically or through a combination thereof.

The present invention is based on the realization that an improved and more reliable hair cutting device can be achieved by reducing the number of moving parts compared to the prior art. Furthermore, the present inventors have realized that an advantageous way of reducing the number of moving parts is to provide an electrical coupling between the comb recognition arrangement and the hair length indicator, and to configure the comb recognition arrangement in such a way that it provides an electronic signal indicative of the hair length that is associated with the comb unit with which the hair cutting device is currently equipped to the hair length indicator.

Hereby, the mechanical arrangement that translates a linear displacement to a rotational movement in the hair cutting device according to WO 2006/134576 can be dispensed with, which provides for a mechanically simpler and more robust hair cutting device.

It is also expected that a hair cutting device according to various embodiments of the present invention will be easier to make water-tight if desired.

Furthermore, providing the hair length (and possibly one or several other characteristics) associated with a particular comb unit to the hair length indicator in electronic form facilitates indication of more than two comb units. Using a comb recognition arrangement with two sensors, such as digital switches, allows for four digital states, which could correspond to a state with no comb unit attached and three different comb units. If the comb recognition arrangement is provided with additional sensors and/or sensor states, further comb units can be recognized and signals indicative of the different comb units easily be transmitted to the hair length indicator.

Moreover, since no mechanical force needs to be transmitted from the comb recognition arrangement to the hair length indicator, which is typically arranged on the other side of the hair cutting device and some distance away from the comb unit, the hair cutting device according to the various embodiments of the present invention should also be easier to operate for the user, in particular when exchanging comb units.

According to various embodiments of the present invention, the hair cutting device may further comprise a user-controllable actuator that is mechanically connected to the comb unit for controlling a position of the comb unit relative to the hair cutting device body to allow for adjustment of the hair length within a hair length range accessible using the comb unit.

The user-controllable actuator may be an actuator that the user moves to adjust the hair length. In this case, the force exerted by the user when moving the actuator is transmitted to the comb unit, possibly through some mechanical transmission.

Alternatively, the user-controllable actuator may be electrically powered to control the position of the comb unit in response to a signal provided by the user.

To always be able to provide the user with the current hair length after cutting, the user-controllable actuator may be operatively coupled to the hair length indicator. The coupling between the user-controllable actuator may be mechanical, electronic or a combination of these.

In the case of a mechanical coupling, a moving part of the hair length indicator may be mechanically coupled to the user-controllable actuator in such a way that a certain movement of the user-controllable actuator leads to substantially equally large displacements of the comb unit and the hair length indicator, respectively. Alternatively, there may be some scaling of the respective displacements.

In the case of an electronic or mechanical/electronic coupling, a certain state of the user-controllable actuator may correspond to the hair length being electronically indicated by the hair length indicator, through an electronic bar indicating the hair length or through numbers or a combination thereof.

According to various embodiments, the hair length indicator may comprise at least a first light-source and a second light-source arranged to be selectively activated based on the electronic signal provided by the comb recognition arrangement.

This provides for an intuitive communication to the user of the current hair length without having to equip the hair cutting device with a large display or an intricate mechanical solution.

Advantageously, the first light-source may be arranged to indicate a first hair length range being associated with a first comb unit, and the second light-source may be arranged to indicate a second hair length range being associated with a second comb unit.

The first light-source and said second light-source may be arranged with a fixed distance there between.

According to various exemplary embodiments, the hair length indicator may comprise a movable mask with a translucent pattern being arranged between the first and second light-sources and a user of said hair cutting device.

The translucent pattern may comprise a first indicator being visible to the user only when the first light-source is activated, and a second indicator being visible to the user only when the second light-source is activated.

According to other embodiments, each of the first light-source and the second light-source may be movable to indicate a current hair length setting to the user.

The first and second light-sources may, for example, be arranged on the same carrier, such as a circuit board, which may be coupled to the user-controllable actuator in such a way that the carrier moves when the user-controllable actuator is operated. In this case a single moving part can selectively indicate two or further different hair length ranges being associated with different comb units, the hair length ranges being indicated by selectively activating the light-source that is associated with the comb unit that is currently attached to the hair cutting device body.

According to various embodiments of the hair cutting device of the present invention, the comb identification member may comprise at least one magnet, and the comb recognition arrangement may comprise at least one sensor for sensing a polarity of a magnetic field generated by the magnet.

In this case, the hair cutting device can be particularly easy to seal because the sensing of the magnetic field can take place through a water-tight cover of the hair cutting device.

Furthermore, the comb identification member may comprise a mechanical structure, and the comb recognition arrangement may comprise a set of switches being arranged to be selectively activated by the mechanical structure.

BRIEF DESCRIPTION OF THE DRAWINGS

These and other aspects of the present invention will now be described in more detail, with reference to the appended drawings showing currently preferred embodiments of the invention, wherein.

DESCRIPTION OF A PREFERRED EMBODIMENT OF THE PRESENT INVENTION

In the following description, the present invention is described with reference to a hair cutting device in which the comb unit is displaceable through mechanical coupling between the comb unit and a user-controllable actuator arranged to be directly operated by the user. It should be noted that this by no means limits the scope of the invention, which is equally applicable to other hair cutting devices in which the comb unit is displaced by a motor that is operated by the user.

Figure 1:
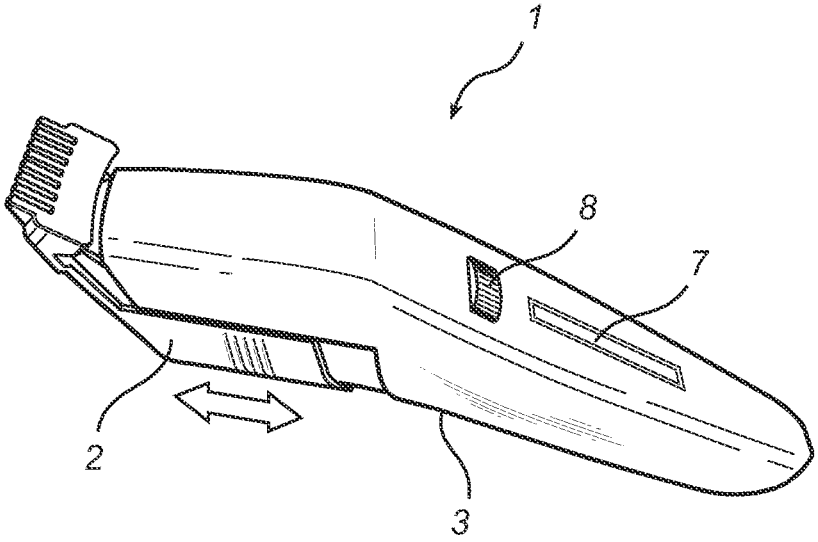
FIG. 1 schematically illustrates an exemplary hair cutting device according to an embodiment of the present invention.

FIG. 1 is a perspective view of an exemplary hair cutting device 1 comprising an interchangeable comb unit 2 and a hair cutting device body 3. The hair cutting device body 3 further comprises a comb interface (not visible in FIG. 1) for releasable attachment of the comb unit 2, a cutting arrangement (not shown in FIG. 1) for cutting the hair, a hair length indicator 7 for indicating the hair length after cutting, and a user-controllable actuator 8 in the form of a control wheel for allowing user control of the position of the comb unit 2 in relation to the cutting arrangement. As can be appreciated from FIG. 1, the hair length after cutting is determined by the properties of the comb unit 2 and the position of the comb unit 2 in relation to the cutting arrangement.

Furthermore, although not explicitly shown in FIG. 1, the user-controllable actuator 8 is also operatively coupled to the hair length indicator 7, so that user operation of the user-controllable actuator 8 results in a changed reading on the hair length indicator 7, in addition to movement of the comb unit 2.

Through the user-controllable actuator 8, the comb unit 2 can be displaced relative to the cutting arrangement by a certain distance, or stroke ΔL, which corresponds to an accessible hair length range HL defined by a minimum hair length $HL_{min}$ and a maximum hair length $HL_{max}$, where $HL_{max}-HL_{min}=\Delta L$.

Clearly, to be able to access a hair length shorter than $HL_{min}$ or longer than $HL_{max}$, the currently attached comb unit 2 should be exchanged for a comb unit having another configuration (length of teeth). According to various embodiments of the hair cutting device according to the present invention, each comb unit has a comb identification member that identifies at least one characteristic of the particular comb unit, such as $HL_{min}$ and/or other properties of the comb unit. When the comb unit is attached to the hair cutting device body 3, this comb identification member is sensed by a comb recognition arrangement (not shown in FIG. 1) comprised in the hair cutting device body 3.

Two exemplary comb identification members and corresponding comb recognition arrangements will now be described with reference to FIGS. 2 and 3.

Figure 2:
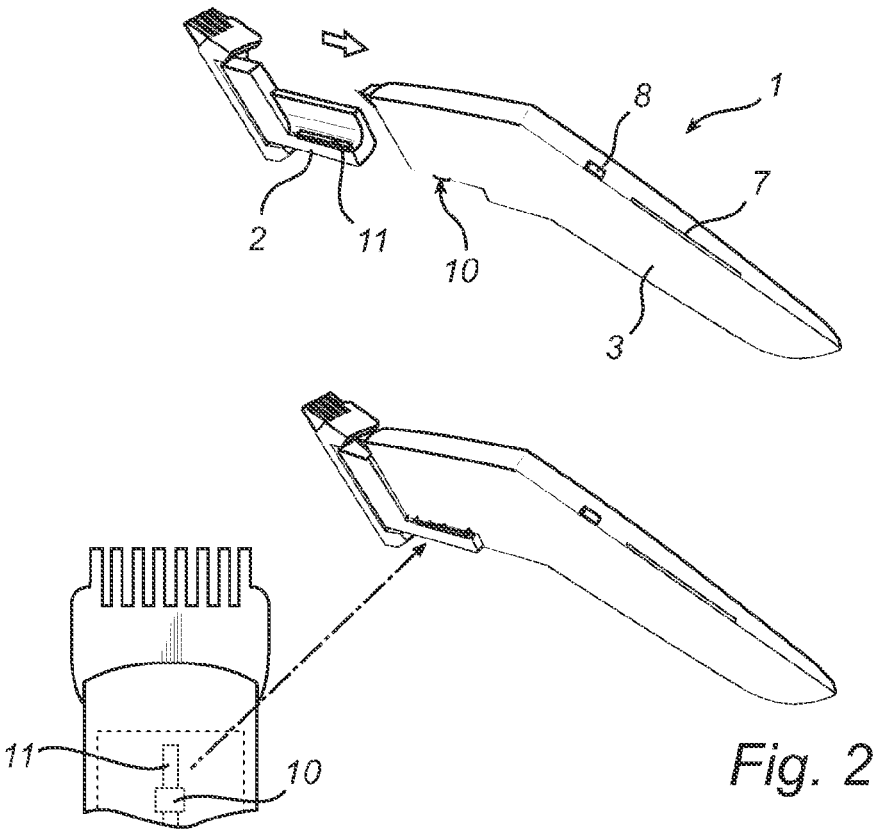
FIG. 2 schematically illustrates identification of a comb unit using a magnet and corresponding sensor.

In FIG. 2, the comb identification member comprises a permanent magnet 10 that is embedded in the comb unit 2. The hair cutting device body 3 comprises a comb recognition arrangement with a magnetic field sensor 11 that can sense presence and polarity of the permanent magnet 10. With the configuration shown in FIG. 2, the comb recognition arrangement can at least distinguish between a state with no comb unit and two different comb units having magnets with opposite polarities. To provide for recognition of further different comb units, the comb recognition arrangement may comprise one or several further magnetic field sensors.

Figure 3:
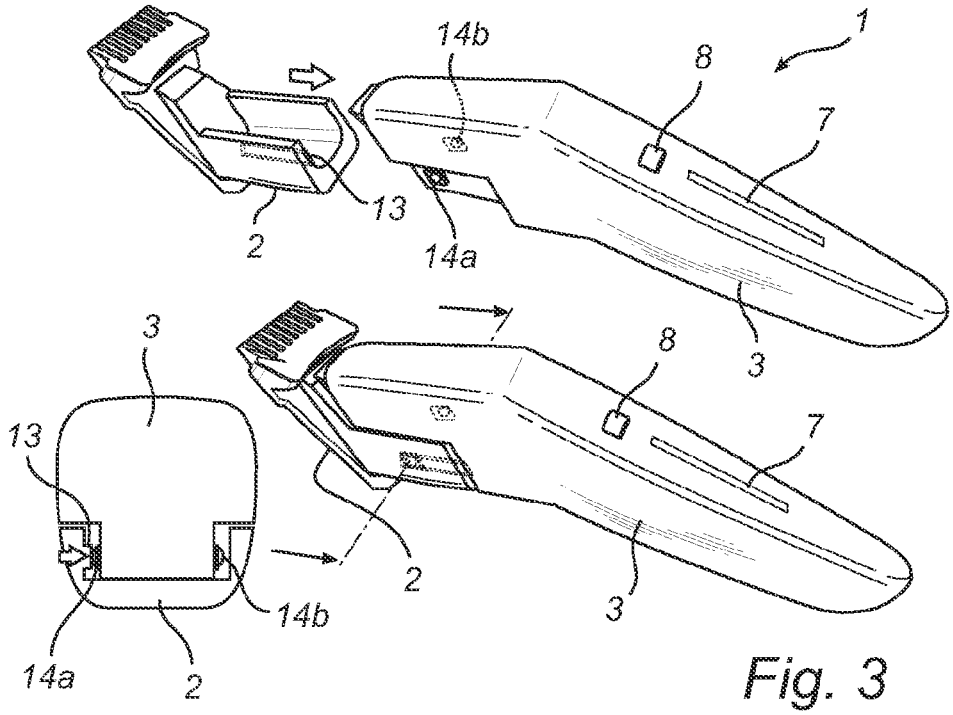
FIG. 3 schematically illustrates identification of a comb unit using a mechanical structure configured to selectively activate a switch in a set of switches.

Turning now to FIG. 3, the comb identification member that is schematically illustrated therein comprises a mechanical structure 13 formed in the comb unit 2. The hair cutting device body 3 comprises a comb recognition arrangement with a set of two switches 14*a-b*. When the illustrated exemplary comb unit 2 is attached to the hair cutting device body 3, the switch 14*a* is activated (depressed), while the switch 14*b* is not activated. With the configuration shown in FIG. 3, the comb recognition arrangement can at least distinguish between a state with no comb unit and three different comb units having different mechanical structures. To provide for recognition of further different comb units, the comb recognition arrangement may comprise one or several additional switches.

One way of using the signal indicative of the hair length associated with the attached comb unit, which is provided by the comb recognition arrangement, is to control a state of a stationary display arrangement comprised in the hair length indicator based on the signal. For example, the display arrangement may comprise an arrangement of light-sources, such as light-emitting diodes (LEDs), or the display arrangement may be an LCD or an OLED-display or similar.

Another way of using the above-mentioned signal provided by the comb recognition arrangement is to control the appearance of a moving hair length indicator based on the comb unit that is currently attached to the hair cutting device.

Below, both of these ways of using the signal provided by the comb recognition arrangement will be described using illustrative exemplary embodiments shown in FIGS. 4*a-c* and FIG. 5, respectively.

Figure 4A:
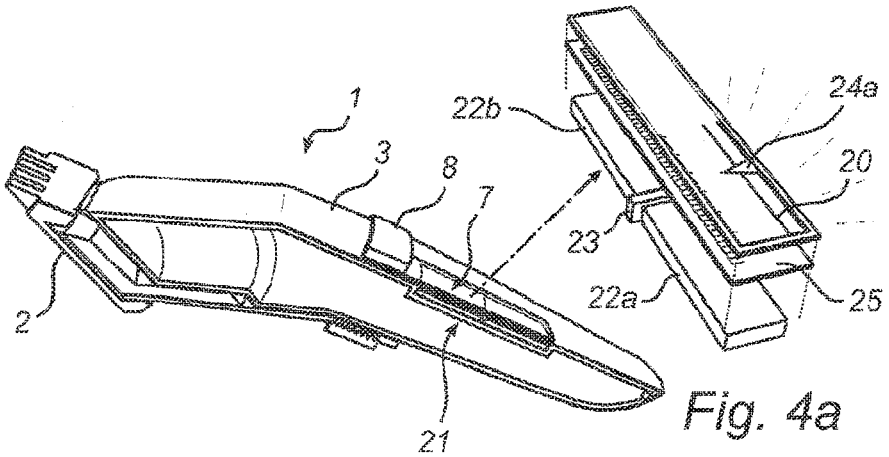
FIGS. 4*a-c* schematically illustrate a first embodiment of the hair cutting device according to the present invention, comprising first and second individually controllable light-sources arranged to illuminate a movable mask.
Figure 4B:
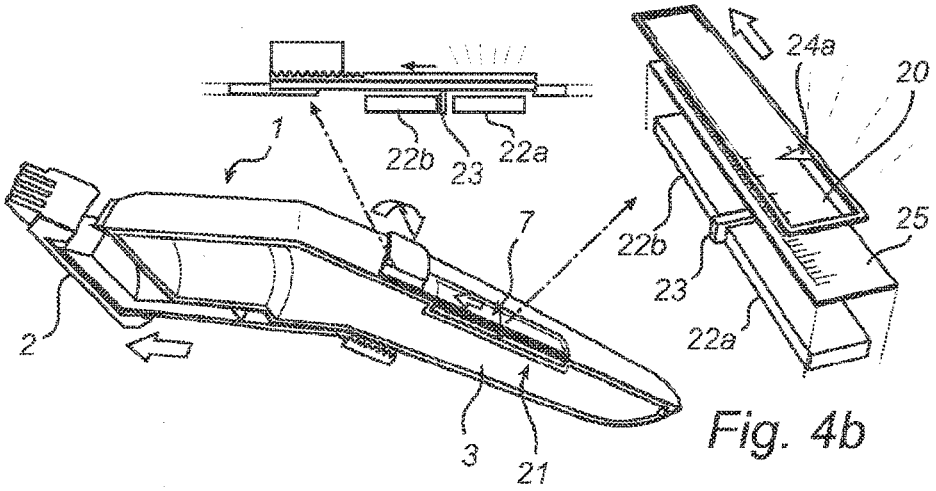
Figure 4C:
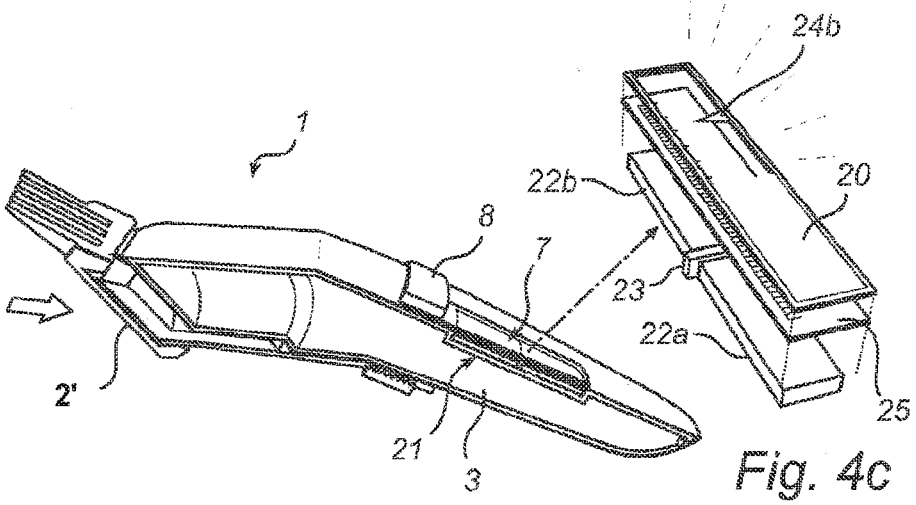

In FIGS. 4*a-c*, a hair cutting device 1 is shown in which the movement of the comb unit 2 relative to the hair cutting device body 3 is controlled using a substantially ring-shaped user-controllable actuator 8, hereinafter referred to as control ring 8. The hair length indicator 7 is arranged on the side of the hair cutting device body 3 opposite the comb unit 2, and is provided in the form of a movable mask 20 arranged in front of a light-source arrangement, here in the form of a segmented back-light arrangement 21.

When the control ring 8 is turned in one direction, the comb unit 2 is pulled towards the control ring 8 and the movable mask 20 is pushed away from the control ring 8, and when the control ring 8 is turned in the opposite direction, the comb unit 2 is pushed away from the control ring 8 and the movable mask 20 is pulled towards the control ring 8.

In the presently illustrated example, the hair length after cutting is illustrated using a pattern provided on the movable mask 20, and the signal provided by the comb recognition arrangement is used to selectively activate the segments comprised in the segmented back-light arrangement 21.

The segmented back-light arrangement 21 comprises a first 22*a* and a second 22*b* segment that are separated by a partition 23 to prevent leakage of light between the segments 22*a-b*. When no comb unit 2 is attached to the hair cutting device body 3, neither segment 22*a-b* will light up. When a comb unit 2 for short cuts is attached to the hair cutting device body 3, the lower segment 22*a* will light up, and when a comb unit 2 for longer cuts is attached to the hair cutting device body 3, the upper segment 22*b* will light up.

FIGS. 4*a-c* schematically illustrate what the user sees in the exemplary case when the hair indicator 7 comprises a segmented back-light arrangement 21, a movable mask 20 with two translucent arrows 24*a-b* provided therein, and a stationary mask 25 with a translucent scale provided therein, the movable mask 20 and the stationary mask 25 being arranged in front of the back-light arrangement 21. In FIG. 4*b*, the comb unit for short cuts is attached to the hair cutting device body 3, resulting in a signal from the comb recognition arrangement that activates the lower segment 22*a* of the back-light arrangement. As a result, the user sees the lower translucent arrow 24*a* indicating a hair length on the lower part of the translucent scale provided in the stationary mask 25. In FIG. 4*c* the situation is shown for the case when a comb unit 2' for a longer hair length is attached to the hair cutting device body 3.

As an alternative to the segmented back-light arrangement 21 in FIGS. 4*a-c*, other types of individually controllable light-sources may be arranged behind the movable mask 20 and the stationary mask 25. For example, LEDs may be used.

Figure 5:
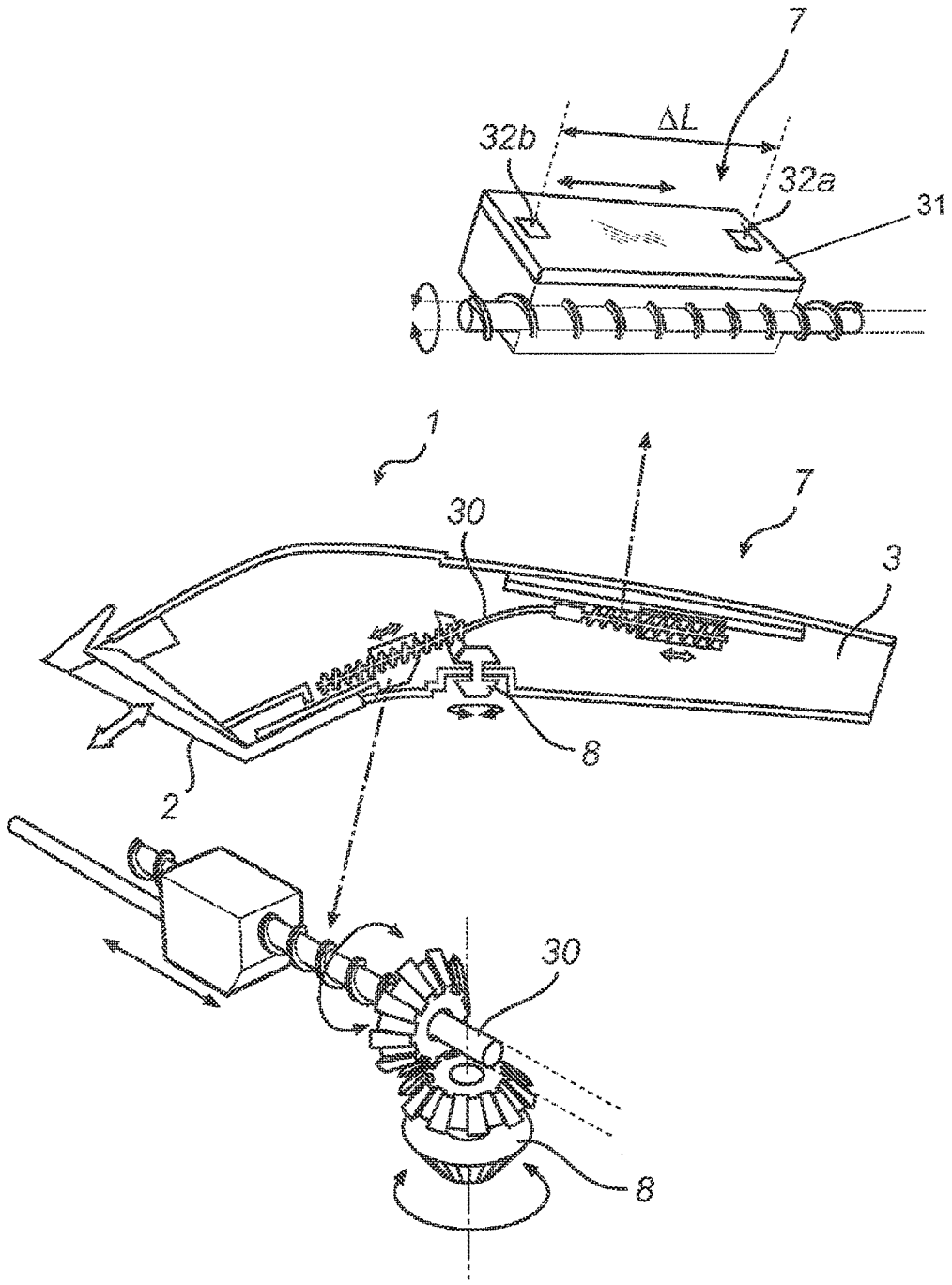
FIG. 5 schematically illustrates a second embodiment of the hair cutting device according to the present invention, comprising first and second individually controllable light-sources arranged on a movable carrier.

In FIG. 5, a hair cutting device 1 is shown in which the movement of the comb unit 2 relative to the hair cutting device body 3 is controlled using a user-controllable actuator 8 in the form of a control wheel arranged on the same side of the hair cutting device as the comb unit 2. The hair length indicator 7 is arranged on the side of the hair cutting device body 3 opposite the comb unit 2, and is provided in the form of a movable circuit board 31 having a first 32*a* and a second 32*b* LED connected thereto.

The control wheel 8 controls a spindle 30 arranged inside the cover of the hair cutting device body 3. When the spindle 30 is turned in one direction, the comb unit 2 is pulled towards the control wheel 8 and the movable circuit board 31 is pushed away from the control wheel 8, and when the spindle 30 is turned in the opposite direction, the comb unit 2 is pushed away from the control wheel 8 and the movable circuit board 31 is pulled towards the control wheel 8.

In the presently illustrated example, the hair length after cutting is illustrated using the position of one of the LEDs 32*a-b* relative to a stationary scale.

As can be seen in FIG. 5, the first 32*a* and the second 32*b* LEDs are arranged on the movable circuit board 31 with a distance substantially corresponding to the stroke ΔL of the comb unit 2. When no comb unit 2 is attached to the hair cutting device body 3, neither LED 32*a-b* will light up. When a comb unit 2 for short cuts is attached to the hair cutting device body 3, the lower LED 32*a* will light up, and when a comb unit 2 for longer cuts is attached to the hair cutting device body 3, the upper LED 32*b* will light up.

In connection with FIGS. 4*a-c* and FIG. 5, two exemplary ways of simultaneously controlling the position of the comb unit 2 and the hair length indicator have been described. As will be readily understood by the person skilled in the art, there are various alternatives that are well within the scope of the present invention. For example, movement of the user-controllable actuator may be translated to movement of more than one spindle. Moreover, the user-controllable actuator may be configured for linear movement rather than rotational movement, etc.

The person skilled in the art realizes that the present invention by no means is limited to the embodiments described above. For example, the user-controllable actuator may be provided through any suitable user-controllable means other than those discussed above. In particular, the user-controllable actuator may comprise, or be controlled through user interaction with a mechanical slider and/or be sensitive to user proximity. In the latter case, the user-controllable actuator may comprise, or be controlled through user interaction with capacitive, optical, piezoelectric or ultrasonic means.

Similarly, the interaction between the comb recognition arrangement and the comb identification member may be based on other physical properties than the mechanical and magnetic interactions exemplified in the above detailed description. For example, the interaction between the comb recognition arrangement and the comb identification member may be based on capacitive coupling, optical sensing, piezoelectric pressure sensing, sensing of heat etc.

The invention claimed is:

1. A hair cutting device comprising:

a hair cutting device body;

an interchangeable comb unit for releasable attachment to said hair cutting device body and for defining a hair length after cutting;

a hair length indicator for being operatively coupled to said interchangeable comb unit for indicating said hair length; and a comb recognition arrangement being electrically coupled to said hair length indicator when said interchangeable comb unit is connected to said hair cutting device body, wherein:

said interchangeable comb unit comprises a comb identification member identifying said hair length associated with said comb unit, said comb identification member being different from a further comb identification member of a further interchangeable comb unit, wherein said hair length indicator comprises at least a first light-source and a second light-source arranged to be selectively activated based on said electronic signal provided by said comb recognition arrangement, and said comb recognition arrangement is configured to sense said comb identification member when said interchangeable comb unit is connected to said hair cutting device body, and to provide an electronic signal indicative of said hair length associated with said comb unit to said hair length indicator, wherein said hair length indicator comprises a movable mask with a translucent pattern arranged over said first and second light-sources.

2. The hair cutting device according to claim 1, wherein said translucent pattern comprises a first indicator being visible through said translucent pattern only when said first light-source is activated, and a second indicator being visible through said translucent pattern only when said second light-source is activated.

* * * * *